US012453915B2

(12) United States Patent
Polokhin et al.

(10) Patent No.: US 12,453,915 B2
(45) Date of Patent: Oct. 28, 2025

(54) METHOD FOR CALIBRATING AN EXTENDED REALITY HEADSET FOR USE WITH EXERCISE EQUIPMENT

(71) Applicant: VR Simulations, Inc., New York, NY (US)

(72) Inventors: Ilya Polokhin, New York, NY (US); Nan Lin Wen, New York, NY (US); Mikhail Zhavoronkov, Novi, MI (US)

(73) Assignee: VR Simulations, Inc., New York, NY (US)

( * ) Notice: Subject to any disclaimer, the term of this patent is extended or adjusted under 35 U.S.C. 154(b) by 87 days.

(21) Appl. No.: 18/098,659

(22) Filed: Jan. 18, 2023

(65) Prior Publication Data

US 2023/0226434 A1 Jul. 20, 2023

Related U.S. Application Data

(60) Provisional application No. 63/300,808, filed on Jan. 19, 2022.

(51) Int. Cl.
*A63B 71/06* (2006.01)
*A63B 24/00* (2006.01)

(52) U.S. Cl.
CPC ..... *A63B 71/0622* (2013.01); *A63B 24/0087* (2013.01); *A63B 2071/0636* (2013.01)

(58) Field of Classification Search
CPC ..... A63B 71/0622; A63B 24/0087; A63B 2071/0636; A63B 2071/0638; A63B 22/02; A63B 2071/0666; G06F 3/011
See application file for complete search history.

(56) References Cited

U.S. PATENT DOCUMENTS

| | | | | |
|---|---|---|---|---|
| 9,686,136 | B1 | 6/2017 | Dey | |
| 10,860,843 | B1 * | 12/2020 | Berme | G02B 27/0179 |
| 2006/0247104 | A1 * | 11/2006 | Grabiner | A63B 69/0064 482/54 |
| 2008/0221487 | A1 * | 9/2008 | Zohar | A61B 5/1127 600/595 |
| 2016/0249700 | A1 * | 9/2016 | Zhavoronkov | A42B 3/0446 2/421 |
| 2021/0001171 | A1 * | 1/2021 | Fung | A63B 22/0292 |
| 2021/0181833 | A1 * | 6/2021 | Morin | A63F 13/833 |

OTHER PUBLICATIONS

ISR of PCT/US23/11082, mailed Apr. 13, 2023.

* cited by examiner

*Primary Examiner* — Andrew M Kobylarz
(74) *Attorney, Agent, or Firm* — Simonelli IP, PLLC

(57) ABSTRACT

A method calibrates an extended reality headset to be worn by a user for use with a piece of exercise equipment having at least one exercise device. The method includes the step of inputting data identifying physical parameters of the at least one exercise device. An operation space is then identified about the at least one exercise device for the user to occupy while using the piece of exercise equipment. A digital control space is then presented with control inputs allowing the user to control the piece of exercise equipment and/or to control the digital rendering of the extended reality environment. A digital rendition of the piece of exercise equipment and the at least one exercise device is rendered in the view of the user wearing the extended reality headset while operating the piece of exercise equipment.

10 Claims, 3 Drawing Sheets

METHOD FOR CALIBRATING AN EXTENDED REALITY HEADSET FOR USE WITH EXERCISE EQUIPMENT

BACKGROUND ART

Field of the Invention

The invention is related to a method for calibrating an extended reality headset to position a piece of exercise equipment in the view generated by the extended reality headset so that the user can use the piece of exercise equipment while wearing the virtual headset.

Description of the Related Art

Conventional 2D screen technology has enabled users to view screens (televisions, tablets, computer screens, phone screens and the like) while performing certain functions, from playing games, to driving vehicles, to exercising. When exercising, the ability to view an image through which the exerciser can pretend to be involved with may motivate or inspire the user to continue exercising. These are commonly shown on the screens that accompany some exercise equipment. For example, running up a hill on the screen may be coordinated with the treadmill increasing its elevation.

However, a 2D screen mounted onto a piece of exercise equipment can only be so immersive. An extended reality headset (XRH) is more immersive in that it encompasses the entire view of the user, the picture changes as the user moves, the visuals are stereoscopic, and the user can interact with virtual objects. And while use of a XRH may be more immersive, a user will have issues with an actual frame of reference in the real world which the user is being active, such as orientation in the extended reality environment (XRE) relative to the real-world surroundings.

SUMMARY OF THE INVENTION

A method calibrates an extended reality headset to be worn by a user for use with a piece of exercise equipment having at least one exercise device. The method includes the step of inputting data identifying physical parameters of the at least one exercise device. An operation space is then identified about the at least one exercise device for the user to occupy while using the piece of exercise equipment. A digital control space is then presented with control inputs allowing the user to control the piece of exercise equipment and/or to control the digital rendering of the extended reality environment.

BRIEF DESCRIPTION OF THE DRAWINGS

Advantages of the invention will be readily appreciated as the same becomes better understood by reference to the following detailed description when considered in connection with the accompanying drawings, wherein.

DETAILED DESCRIPTION OF THE PREFERRED EMBODIMENT

Figure 1:
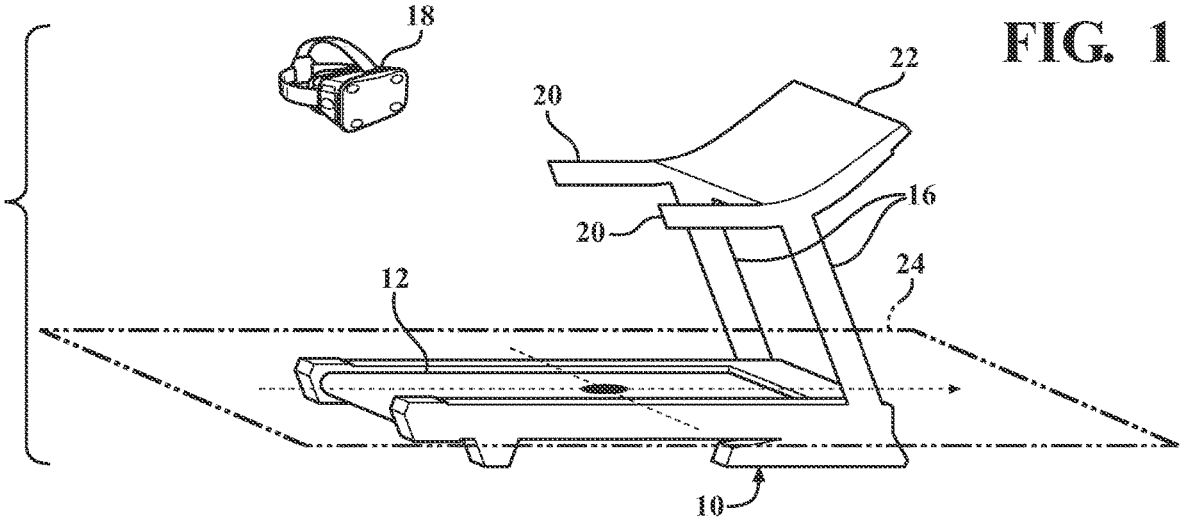
FIG. 1 is a perspective view of a piece of exercise equipment with an imaginary plane referencing a floor of the piece of exercise equipment.
Figure 2:
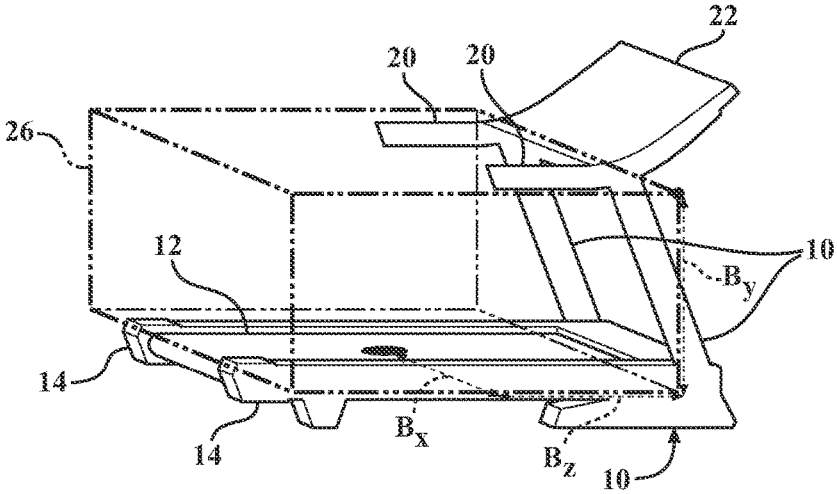
FIG. 2 is a perspective view of a piece of exercise equipment with an imaginary occupancy space shaded in referencing a space a user may occupy when using the piece of exercise equipment.
Figure 3:
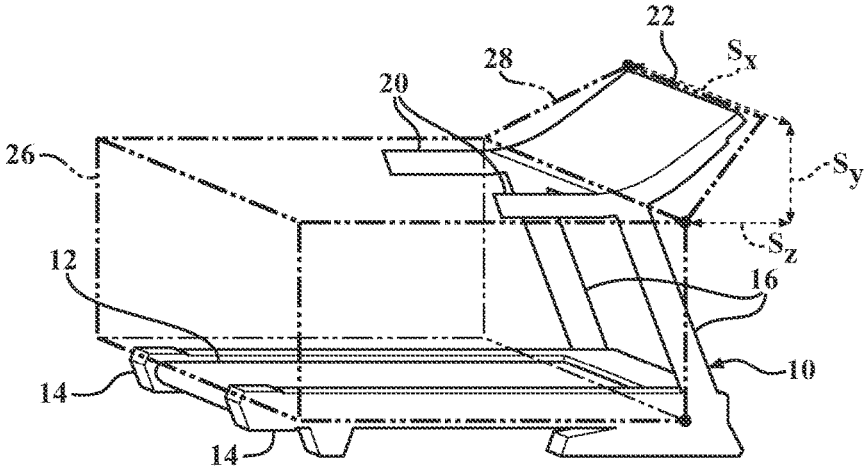
FIG. 3 is a perspective view of a piece of exercise equipment with an imaginary control space shaded in, along with the shaded imaginary occupancy space, of the piece of exercise equipment.

Referring to FIGS. 1 through 3, a piece of exercise equipment is generally indicated at 10. The exercise equipment 10 is shown to be a treadmill. It should be appreciated by those skilled in the art that the piece of exercise equipment 10 can be any type of exercise equipment, including stationary bicycles, elliptical trainers, rowing machines stair-steppers and the like.

Through the use of this method of calibration, the exercise equipment 10 is able to be used while the user wears an XRH, generally shown at 18. It should be appreciated by those skilled in the art that an XRH 18 can include extended reality, virtual reality, augmented reality, mixed reality, and any other visual rendering that allows a user to move his or her body understanding that the physical movements will affect the display being shown to the user wearing the headset.

The exercise equipment 10 includes at least one exercise device 12. In the examples described hereinafter and shown in the Figures, the piece of exercise equipment is a treadmill 10 includes an infinite loop tread 12 as the at least one exercise device 12. Like all exercise devices 12, the infinite loop tread 12 is designed to be occupied by a user thereof. The user may do any movement he or she desires. It is common for a user to walk, jog or run along the infinite loop tread 12 and is typically referred to as a running deck. The infinite loop tread 12 is surround on at least three sides by a frame 14.

Extending up from the frame 14 are two uprights 16. The uprights 16 position two handrails 20, one on either side of the infinite loop tread 12. The handrails 20 are used to help a user balance and steady himself or herself during and after use of the treadmill 10.

A control console 22 extends between the two handrails 20 up and away from the treadmill 10 at an angle so that the control console 22 is easily visible to the user during normal operation. Buttons and display screens (neither shown) are operable on the control console 22 as is known in the art.

Figure 4:
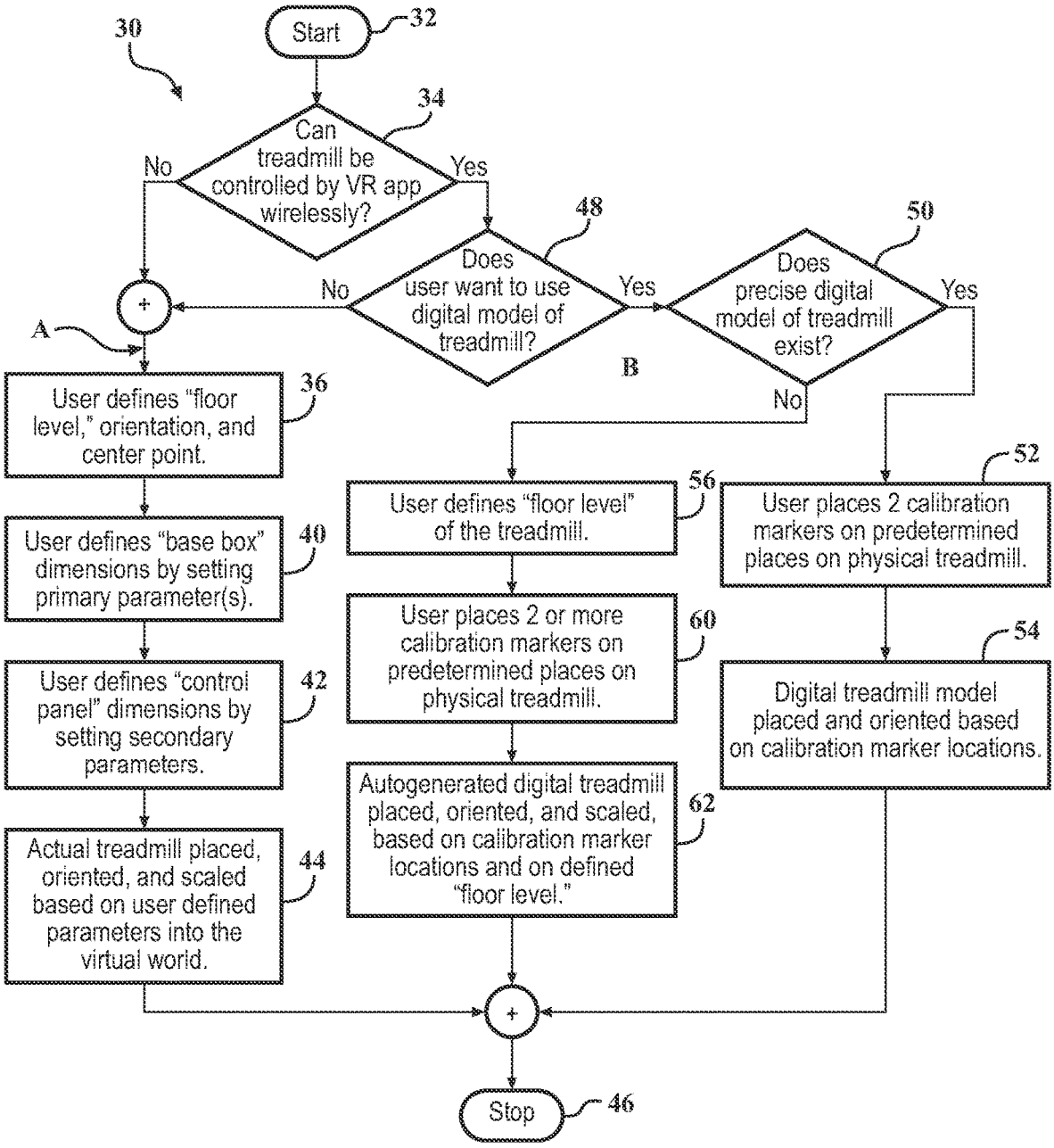
FIG. 4 is a logic chart showing one embodiment of the method of operation.

Referring to FIG. 4, one embodiment of a method to calibrate a XRH 18 is generally shown at 30. The method 30 begins at 32. A first step in this method 30 is identifying whether or not the exercise equipment 10 can be controlled by a XRH 18 or software that is interoperable with the XRH 18 (e.g., an app that controls the XRH 18). This is done at 34. If the exercise equipment 10 cannot be controlled by a XRH 18, the method 30 begins down a path generally indicated as path A.

In path A, the user inputs data identifying the physical parameters of the at least one exercise device (infinite loop 12). In the example shown, the user defines an interface surface, which is a floor 24 (graphically represented in FIG. 1), which is coplanar with the top flat portion of the infinite loop 12. The XRH 18 may have software to enable the user to identify the floor. In order to utilize this function, the user must be standing on the infinite loop 12 while he or she is running the floor-identifying subroutine. If the user cannot or does not want to utilize the subroutine, he or she may use hand gestures (hand tracking) at, on or sufficiently near the infinite loop 12 to identify its location. While the XRH 18 may include the option to wear gloves with sensors, it is not likely due to the fact that the user will be exercising and not likely willing to wear additional pieces of clothing. It is through this surface, the top flat portion of the infinite loop tread 12 that the user physically contacts the piece of exercise equipment 10. This is done at step 36.

The user then identifies an operation space. This is the space occupied by the user and the exercise equipment 10 during operation. In the embodiment shown, the operation space is referred to as the base box 26 (shown in FIG. 2) and identifying it occurs at step 40. The base box 26 is defined by three dimensions: $B_x$, $B_y$ and $B_z$. $B_x$ is the distance from one of the handrails 20 to a center point 55 of the infinite loop tread 12. $B_y$ is the length between the infinite loop tread 12 and the handrails 20. $B_z$ is distance from the center point 55 to a front edge 25 of the infinite loop tread 12. These distances $B_x$, $B_y$ and $B_z$ are from the perspective of the user standing on the infinite loop tread 12 facing forward. The base box 26 is designed to extend behind the user in a manner that will allow the user the space needed to utilize more of the space on the infinite loop tread 12 than just the portion in front of the user. Although different manufacturers have products of different dimensions, doubling the length of $B_z$ generally provides adequate room in the base box 26 for operation by the user regardless of the exercise equipment 10 being used.

The user may extend higher than the handrails 20, but the user cannot violate the other two dimensions and operate the exercise equipment 10 as it was designed. The base box 26 is created by using pointing gestures and the like that are known in the art of the XRH 18.

At 42, the method presents a control space 28 (shown in FIG. 3). This is the space in the XRE that allows the user to see the control console 22. As with the base box 26, the control space 28 is created by using pointing gestures and the like that are known in the art. Pointing gestures include, but are not limited to, hand tracking and the point of game controllers. Generally, the control space 28 is defined by three dimensions $S_x$, $S_y$, and $S_z$, as is shown in FIG. 3.

Once the three spaces/boundaries including the floor 24, the base box 26, and the control space 28 are created, the exercise equipment 10 is presented through the XRH 18 at 44. The user views the exercise equipment 10 when the XRH 18 is in pass through mode. More specifically, the method 30 allows the XRH 18 to present a video display of the exercise equipment 10 as it actually looks in real time while it is being operated by the user. The floor 24, base box 26, and control space 28 are oriented to match the actual exercise equipment 10. In addition, the orientation of exercise equipment 10 equates to directing the user to exercise in the correct direction and orientation. The user can see the virtual world overlayed over the actual exercise equipment 10 allowing the user to see a hybrid view of both the actual exercise equipment 10 and virtual world.

Once the calibration of the XRH 18 with respect to the exercise equipment 10 is completed, the method stops at 46 and the user can exercise on the exercise equipment using the XRH 18. Because the XRH 18 is calibrated without any data cross-communication, any inputs into the treadmill 12 through its controls needs to be entered independently into the XRH 18. More specifically, the data needs to be entered twice because the XRH 18 and the treadmill 12 are not communicating with each other.

Returning to decision diamond 34, if it is determined that the exercise equipment 10 can be controlled by a XRH 18 or software that is interoperable with the XRH 18, the method 30 determines whether the user wants to utilize a digital model of the treadmill 10 at 48. If the user wants to see the actual treadmill 10 and not a digital rendering of it, the method 30 returns to step 36 in path A to calibrate the treadmill 10. If the user does want to use a digital rendering of the treadmill, the method 30 turns along path B to use that information to help calibrate the XRH 18. If the user decides to calibrate the exercise equipment 10 using path A, the user will not have to independently enter data in the virtual and real controls because the XRH 18 and the exercise equipment 10 can communicate wirelessly.

Figure 5:
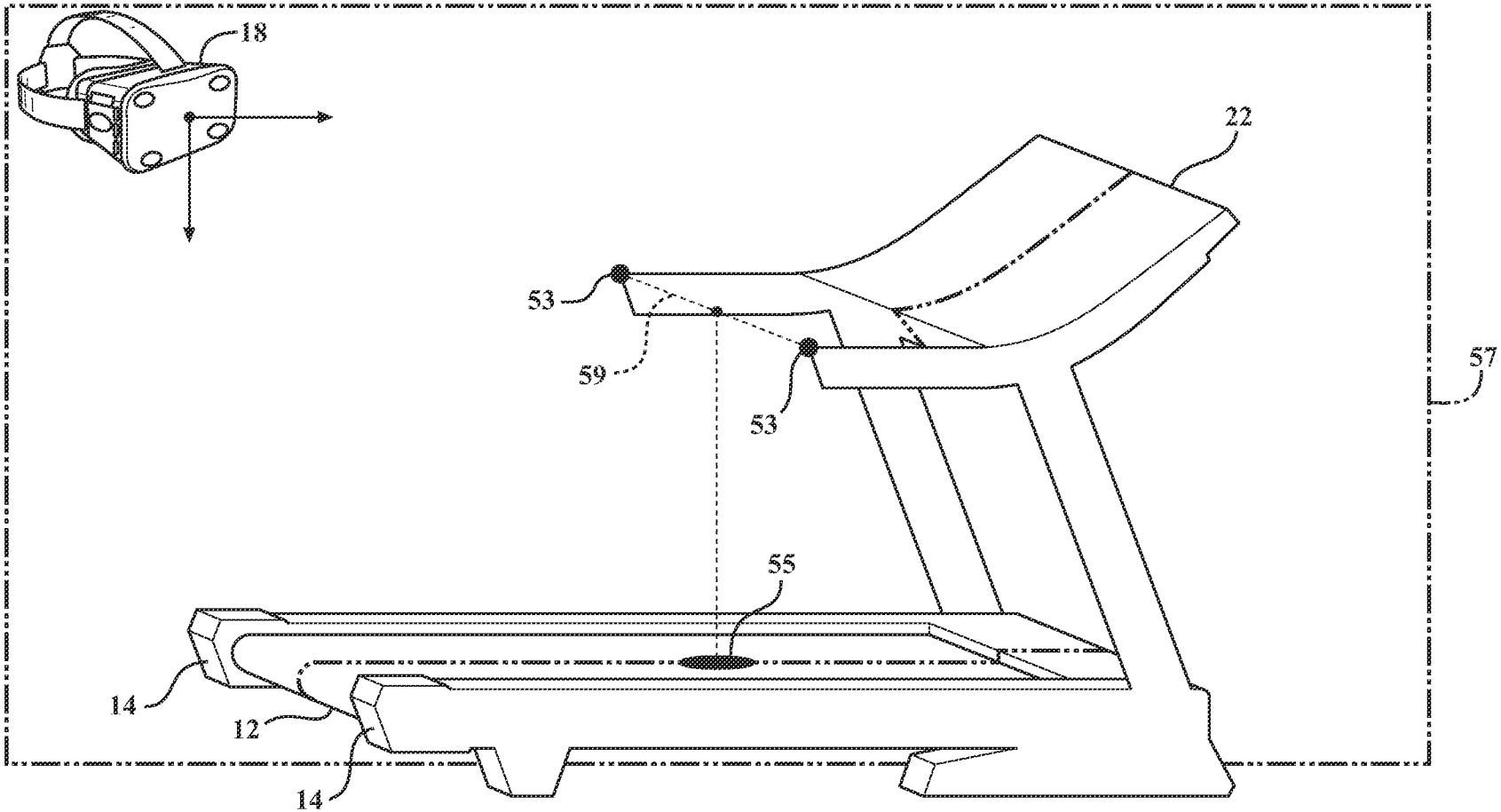
FIG. 5 is a perspective view of a piece of exercise equipment wherein the calibration of the XRH is done using a path B shown in FIG. 4.

Beginning with a decision at 50, the method 30 determines whether a precise digital model of the exercise equipment 10 exists. If so, the XRH 18 recognizes the exercise equipment 10 and uploads the characteristics and dimensions of the exercise equipment 10. Then, the user inputs at least one calibration point at 52 which are actual physical points of the exercise equipment 10. In one embodiment, the user merely locates the distal ends 53 of each of the handrails 20 and the digital model of the exercise equipment 10 can be uploaded. This is best shown in FIG. 5. Once uploaded, the digital rendering of the exercise equipment 10 can be displayed through the XRH 18 at 54 and the method 30 terminates at 46. By identifying the distal ends 53 of the handrails 20, the XRH 18 can calculate the center point 55 of the infinite loop tread 12. The XRH 18 may also define a plane 57 perpendicular to a segment 59 extending between the two distal ends 53 to assist in the operation of the XRH 18 with the treadmill 12.

If it is determined at decision diamond 50 that a precise model is not available, the user may need to identify the floor 24 by identifying the level, orientation, and center point thereof. This is done at step 56.

Once the floor 24 is located, the user can locate at least one defined point of the exercise equipment 10 at 60, similar to step 52 discussed above. It should be appreciated by those skilled in the art that two or more defined points may be used at 60 to locate the operational space of the exercise equipment. With the defined floor 24 and the at least one calibration points identified, the digital rendering of the exercise equipment 10 can be displayed through the XRH 18 at 62. More specifically, the exercise equipment 10 may be digitally rendered by the XRH 18 by autogenerating where the image is placed, oriented, and scaled based on the calibration points or marker entered by the user. The calibration method can be terminated at 46.

The invention has been described in an illustrative manner. It is to be understood that the terminology, which has been used, is intended to be in the nature of words of description rather than of limitation.

Many modifications and variations of the invention are possible in light of the above teachings. Therefore, within the scope of the appended claims, the invention may be practiced other than as specifically described.

We claim:

1. A method for calibrating an extended reality headset to be worn by a user for use with a piece of exercise equipment having at least one exercise device, the method comprising the steps of:

identifying an operation space about the at least one exercise device for the user to occupy while using the piece of exercise equipment;

presenting a digital control space with control inputs allowing the user to input control inputs into the extended reality headset while being used during exercise;

viewing the exercise equipment in pass-through mode as it actually looks in real time while it is being operated by the user; and creating a digital rendering of the piece of exercise equipment so that the at least one exercise device is visible to the user when the user is wearing the extended reality headset while operating the piece of exercise equipment in a mode other than the pass-through mode.

2. A method as set forth in claim 1, wherein the step of identifying an operation space includes the step of identifying an interface surface at which the user physically contacts the piece of exercise equipment.

3. A method as set forth in claim 2, wherein the step of identifying the interface surface includes the step of locating an infinite loop tread and a top flat portion thereof.

4. A method as set forth in claim 3, including the step of defining a floor coplanar with the top flat portion of the infinite loop tread.

5. A method as set forth in claim 1, wherein the step of identifying the operating space includes inputting location information for handrails.

6. A method as set forth in claim 5, wherein the step of presenting the control space includes the step of defining a location for the control space to present operational parameters of the piece of exercise equipment while it is being operated.

7. A method as set forth in claim 1, including the step of creating a hybrid view showing a virtual reality and the video display of the actual exercise equipment in a pass through mode.

8. A method for imaging a digitally rendered piece of exercise equipment in an extended reality headset to be worn by a user for use with a piece of exercise equipment having at least one exercise device, the method comprising the steps of:

recognizing the piece of exercise equipment;

uploading a digital representation of the piece of exercise equipment;

identifying at least one calibration marker; and viewing the exercise equipment in pass through mode as it actually looks in real time while it is being operated by the user.

9. A method as set forth in claim 8, including the step of inputting data identifying a physical parameter of the at least one exercise device.

10. A method as set forth in claim 9, wherein the step of identifying at least one calibration marker includes identifying at least a second calibration marker.

* * * * *